US006328600B1

(12) United States Patent
Fujiki et al.

(10) Patent No.: US 6,328,600 B1
(45) Date of Patent: Dec. 11, 2001

(54) HORIZONTALLY AND VERTICALLY CONVERTIBLE CONNECTOR FOR PRINTED CIRCUIT BOARDS

(75) Inventors: Akihiko Fujiki, Okayama; Yutaka Ushiro, Daito; Katsuyuki Masaki, Hyogo, all of (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 09/526,208

(22) Filed: Mar. 15, 2000

(30) Foreign Application Priority Data

Mar. 15, 1999 (JP) ..... 11-068417

(51) Int. Cl.[7] ..... H01R 13/66
(52) U.S. Cl. ..... 439/570; 439/83
(58) Field of Search ..... 439/570, 954, 439/83, 571, 151, 171, 224, 518, 441

(56) References Cited

U.S. PATENT DOCUMENTS

| | | | | |
|---|---|---|---|---|
| 4,509,811 | * | 4/1985 | Amano et al. | 439/77 |
| 4,645,287 | * | 2/1987 | Olsson | 439/571 |
| 4,668,040 | * | 5/1987 | Matsuzaki et al. | 439/571 |
| 6,022,244 | * | 2/2000 | Chiu | 439/570 |
| 6,109,952 | * | 8/2000 | Jaag | 439/441 |

FOREIGN PATENT DOCUMENTS 2628002 4/1997 (JP) .

* cited by examiner

*Primary Examiner*—Paula Bradley
*Assistant Examiner*—James R. Harvey
(74) *Attorney, Agent, or Firm*—Antonelli, Terry, Stout & Kraus, LLP

(57) ABSTRACT

A connector (1) for printed circuit boards (25) has an insulated housing (2), contacts (3) each with a lead (13) protruding from the contact to be soldered to a circuit pattern (26), and reinforcement metals (4) fixed in both sides of the housing and capable of soldering to a fixation pattern (27) on a board. These housing (2), contacts (3) and metals (4) are useful as they are, whether the connector takes a top type or a side type position. Each lead (13) and metal (4) respectively have first solderable portion (14) and zone (22) for top type position, and second solderable portion (15) and zone (23) for the side type position. The first portions and zones extend along the housing's bottom (5), the second portions and zones extending along the housing's front wall (6) or rear wall (7), such that the housing, contacts and metals need no change in shape between the top type and side type position so that the connector is made efficiently with reduced facility investment and with reduced sorts of its parts, lowering manufacture cost and facilitating stock control of parts.

8 Claims, 8 Drawing Sheets

1
2
3
4
5
6
7
8
9
11
11a
12
13
14
15
16
17
18
20
21
22
23
25

1
2
3
4
5
6
7
8
9
11
11a
12
13
14
15
17
20
21
22
23
25

HORIZONTALLY AND VERTICALLY CONVERTIBLE CONNECTOR FOR PRINTED CIRCUIT BOARDS

BACKGROUND OF THE INVENTION

1. Field of the Invention

The present invention relates to a connector adapted for use with printed circuit boards and capable of being surface mounted thereon.

2. Prior Art

The known connector of this type for use with the printed circuit boards comprise each an elongate rectangular box as an insulated housing. The latter generally has an upper opened connecting portion for reception of conductive parts or elements leading to the circuit board. Leads integral with contacts held in the housing protrude outwards therefrom so as to be soldered to a circuit pattern printed on the board. Reinforcement metal pieces are fixed in the both sides of said housing are to be soldered to a fixation pattern that is also previously formed on each printed circuit board. Those prior art connectors are grouped into the so-called 'top' type and the so-called 'side' type. In the former type, a bottom of the housing will rest on the upper face of the printed circuit board so that the connecting portion opens upwards. In the latter type of the connectors, either a front side or a rear side of the housing will lie on said board so as to dispose the connecting portion to face sideways.

If those two types of the connectors are manufactured independently of each other, their insulated housings, their contacts and their reinforcement metals will differ between said types. This will not only raise manufacture cost and but also increase the number of constituent parts, noticeably rendering intricate the stock control of them. Therefore, the present applicant has developed and put into practical use a certain convertible type of connectors having their housings and reinforcement metals compatible with both the types. The contacts in such novel connectors already proposed by the present applicant need only be changed in position of their leads between the types, and relative to bodies of said contacts (see the Specification of Japanese Patent No. 2628002).

SUMMARY OF THE INVENTION

A primary object of the present invention is to provide a further improved connector adapted for printed circuit boards and having a feature that all of insulated housing, reinforcement metal pieces and contacts of the connector can take as a whole a top type position, with a possibility of alternatively taking a side type position on demand without any change made in their shape. This improvement will be useful to raise manufacture efficiency (and reduce facility investment, by decreasing variety of constituent parts of the connectors as a whole). Such a further improvement will lower manufacture cost to a remarkable degree and will render much easier the stock control of parts.

Another object of the present invention is to provide such a connector for printed circuit boards that it can be 'surface mounted' on a reduced area of the circuit board, thus enhancing density of various electric parts and devices mounted thereon. The reinforcement metal pieces in the connector has now to be more firmly fixed on the circuit board and be never peeled off accidentally and unintentionally, thus improving reliability thereof.

In order to achieve these objects, a connector proposed herein does comprise leads that are integral with contacts held in an insulated housing, the leads protruding outwards therefrom so as to be soldered to a circuit pattern printed on the board. The connector further comprises reinforcement metal pieces are fixed in both sides of said housing so as to be capable of being soldered to a fixation pattern formed on the circuit board, wherein all of these housing, contacts and metal pieces are convertible between an upright standing posture (viz., the top type position) and a lying-on-one-side posture (viz., the side type position) which the connector may selectively assume.

In detail, the lead extending from each contact has characteristically a first solderable surface portion and at least one second solderable surface portion, wherein the former surface portion extends in parallel with a bottom of the housing so as to be used where the standing top-type position is taken, with the latter surface portion extending in parallel either with a front wall or a rear wall of said housing for use in an alternative case of the lying side-type position. Also characteristically, each reinforcement metal piece has a first solderable surface zone and at least one second solderable surface zone, wherein the former zone extends in parallel with the housing bottom for use where the standing top-type position is taken, with the latter zone extending in parallel either with the front or rear wall of said housing for use in the alternative case of the lying side-type position.

Each reinforcement piece preferably and generally consists of a metal sheet or plate having rim portions, one of these rim portions serving as the first solderable zone and another one serving as the second solderable zone. Each reinforcement piece fixedly fits in one of slots or apertures that are formed in side walls of the insulated housing.

Preferably, each contact may have two second solderable surface portions respectively along the front and rear walls of the housing, and each reinforcement piece may also have two second solderable surface zones, similarly along the front and rear walls of the housing. In this case, either the front wall or the rear wall may selectively be laid on the upper face of the printed circuit board, further increasing freedom in the manner of 'surface mounting' the connector.

It is preferable that one and single layout of the circuit pattern and fixation pattern does suffice by matching both the arrangement of the first solderable portions and zones in the top type position and the other arrangement of the second solderable portions and zones in the side type position of the connector.

BRIEF DESCRIPTION OF THE DRAWINGS

FIG. 6(*b*) is a cross section of the connector shown at its area where one of its contacts is disposed;

FIG. 6(*c*) is a cross section of the connector shown at its another area where one of its reinforcement metals is disposed;

FIG. 7(*b*) is a cross section of the side type connector shown at its area where one of its contacts is disposed;

FIG. 7(*c*) is a cross section of the side type connector shown at its another area where one of its reinforcement metals is disposed;

FIG. 9(*b*) is a front elevation of the principal part of the alternative connector;

FIG. 9(*c*) is a side elevation of the alternative connector;

FIG. 9(*d*) is a cross section taken along the line d—d in FIG. 9(*a*), showing the alternative connector at its area where one of its contacts is disposed;

FIG. 9(*e*) is a cross section taken along the line e—e in FIG. 9(*a*), showing the alternative connector at its another area where one of its reinforcement metals is disposed;

FIG. 10(*b*) is a front elevation of the principal part of the further alternative connector;

FIG. 10(*c*) is a side elevation of the further alternative connector; and

FIG. 10(*d*) is a cross section taken along the line d—d in FIG. 10(*a*), showing the further alternative connector at its area where one of its reinforcement metals is disposed.

THE PREFERRED EMBODIMENTS

Figure 1:
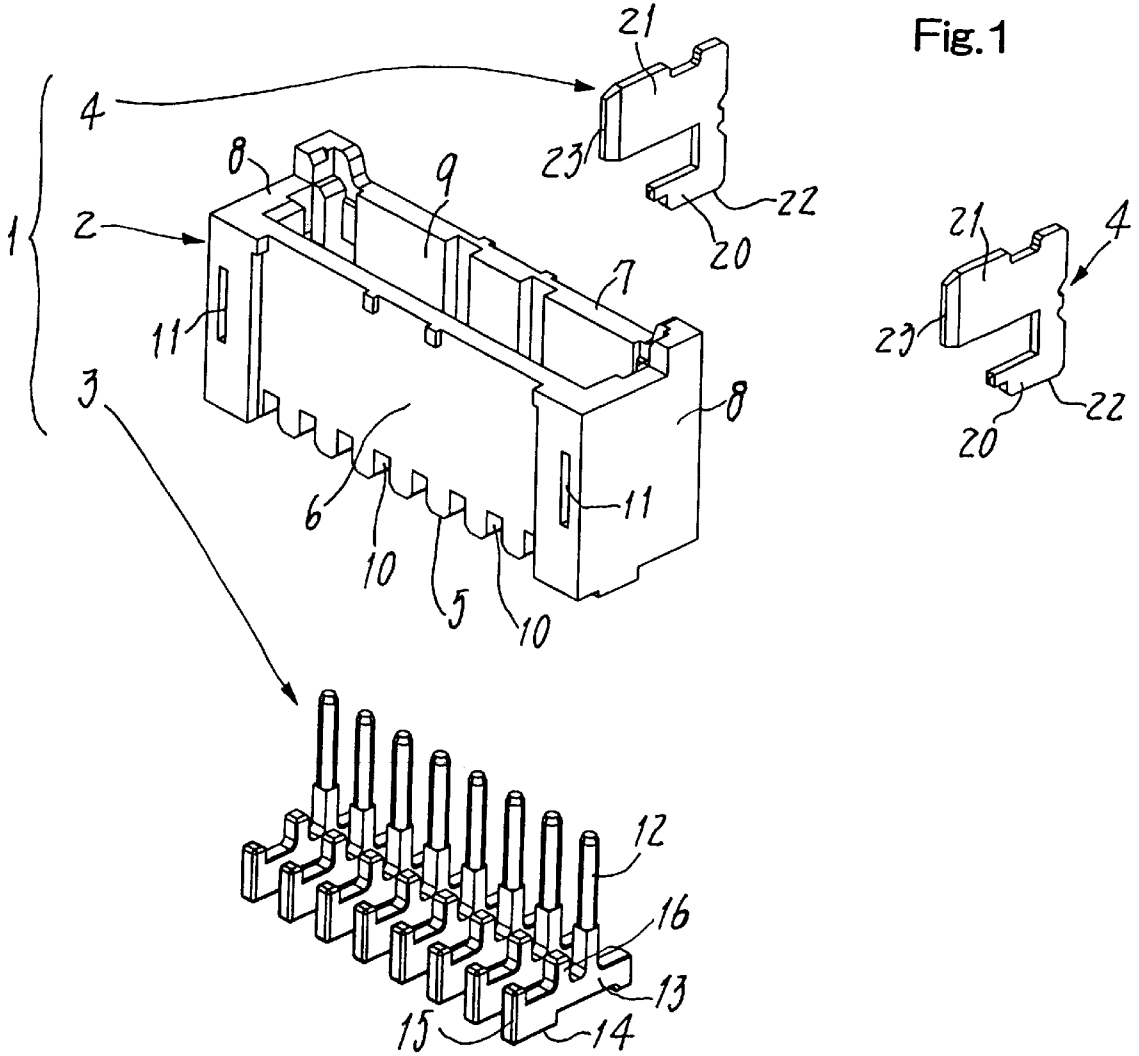
FIG. 1 is an exploded perspective view of a connector provided herein for printed circuits.
Figure 2:
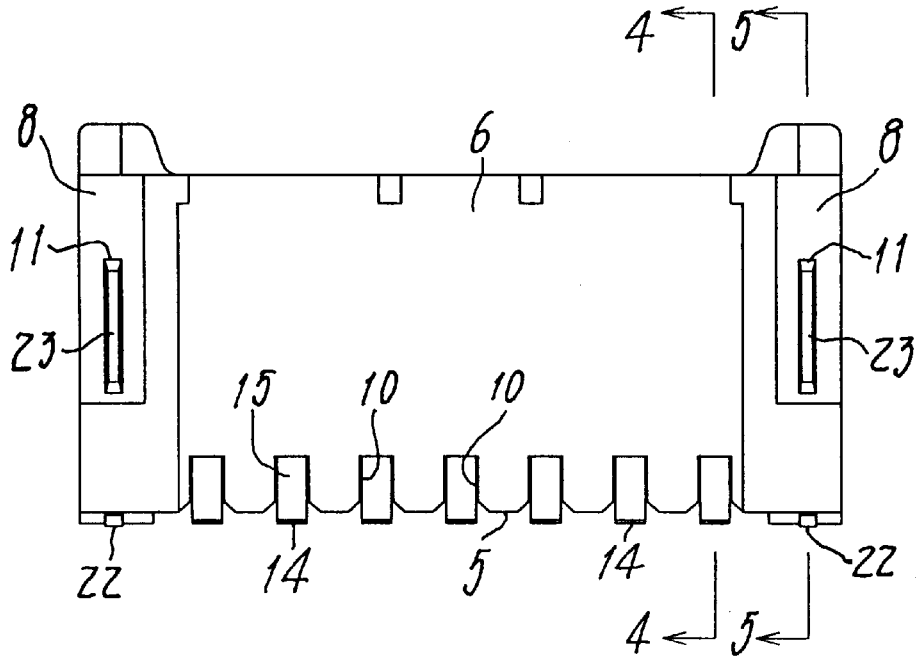
FIG. 2 is a front elevation of the connector.
Figure 3:
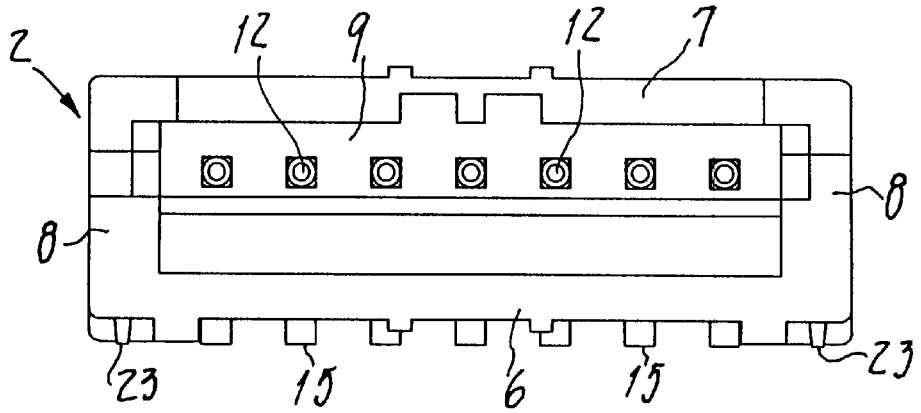
FIG. 3 is a plan view of the connector.

Now, some preferable embodiments of the present invention will be described referring to the drawings.

FIGS. 1 to 5 illustrate as a whole a connector 1 provided herein as a pin header for use with printed circuit boards. This connector 1 is composed of an insulated housing 2, a row of contacts 3 held at a regular pitch in the housing 2, and reinforcement metal pieces 4 that are fixed in both side ends of said housing.

The housing 2 is an elongate box made from an insulating material and having an opening facing upwards. The opening in the box is defined between a bottom 5, a front wall 6, a rear wall 7 and opposite lateral walls 8 and 8. The open top 9 of the housing serves as a connecting mouth for a mating connector (not shown). Groove-shaped cutouts 10 are formed at a constant pitch in the bottom 5 so as to respectively engage with the contacts 3. Apertures 11 and 11 are formed in the lateral walls 8 so as to receive and firmly hold therein the respective reinforcement metals 4.

Figure 4:
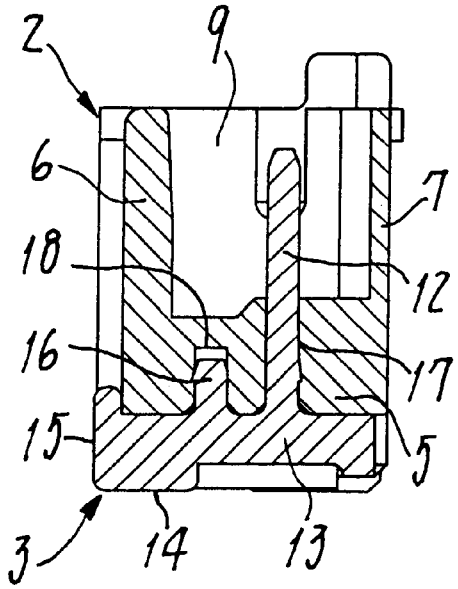
FIG. 4 is a cross section taken along the line 4—4 in FIG. 2.

The contacts 3 are manufactured by punching a conductive metal plate and pressing punched pieces. A contact pin 12 as one portion of each contact has a lower end from where a lead 13 extends integrally and in opposite directions. The lead has an end (located adjacent to the front wall 5 of the housing 2) providing a first solderable surface portion 14 for the top type position as well as a second solderable portion 15 for the side type position of the connector. Those neighboring solderable portions 14 and 15 of each lead do extend perpendicular to each other and have the same width and the same length. A short support lug 16 protrudes from the lead 13 and in parallel with the contact pin 12. As shown in FIG. 4, each contact 3 is inserted in a setting hole 17 formed in the bottom 5 of the housing 2 so that the short lug 16 tightly fits in a support hole 18, with the lead 13 also snugly engaging with the groove-shaped cutout 10. In such an assembled state of the connector, the first solderable surface portion 14 for the top type position will extend substantially aligned with the outer face of the bottom 5. The second solderable portion 15 for the side type position of the connector will extend in parallel with the outer face of the front wall 6.

Figure 5:
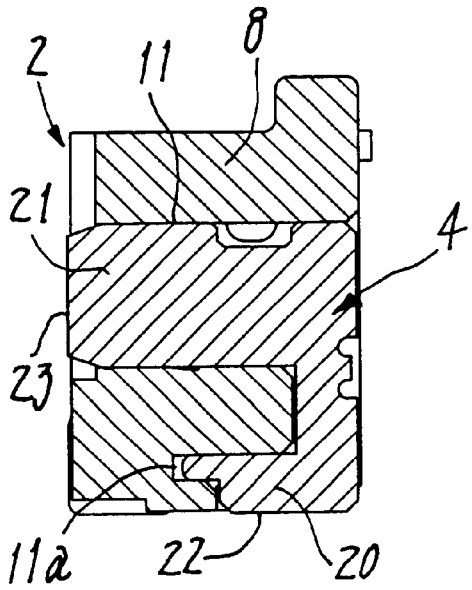
FIG. 5 is a cross section taken along the line 5—5 in FIG. 2.

The reinforcement metal pieces 4 are manufactured similarly by punching the same or another conductive metal plate and pressing punched pieces. An upper arm 21 of each U-shaped metal piece 4 is broader and longer than a lower arm 20 thereof. A lower ridge of this lower arm serves as a first solderable zone for the top type position of the connector, while a frontal edge of the upper arm 21 serving as a second solderable zone for the side type position. Those solderable zones 22 and 23 are of the same width and the same length. As seen in FIG. 5, the upper arm 21 of each reinforcement piece 4 is fitted in the aperture 11 pierced through the housing 2 from the rear face to front face thereof. A frontal edge of the lower arm 20 fits in a groove 11*a* that is formed in the side wall 8 and near the bottom 5. In such an assembled state of the connector, the first solderable surface zone 22 for the top type position will extend substantially aligned with the outer face of the bottom 5, whereas the second solderable zone 23 for the side type position extends along the outer face of the front wall 6.

Figure 6:
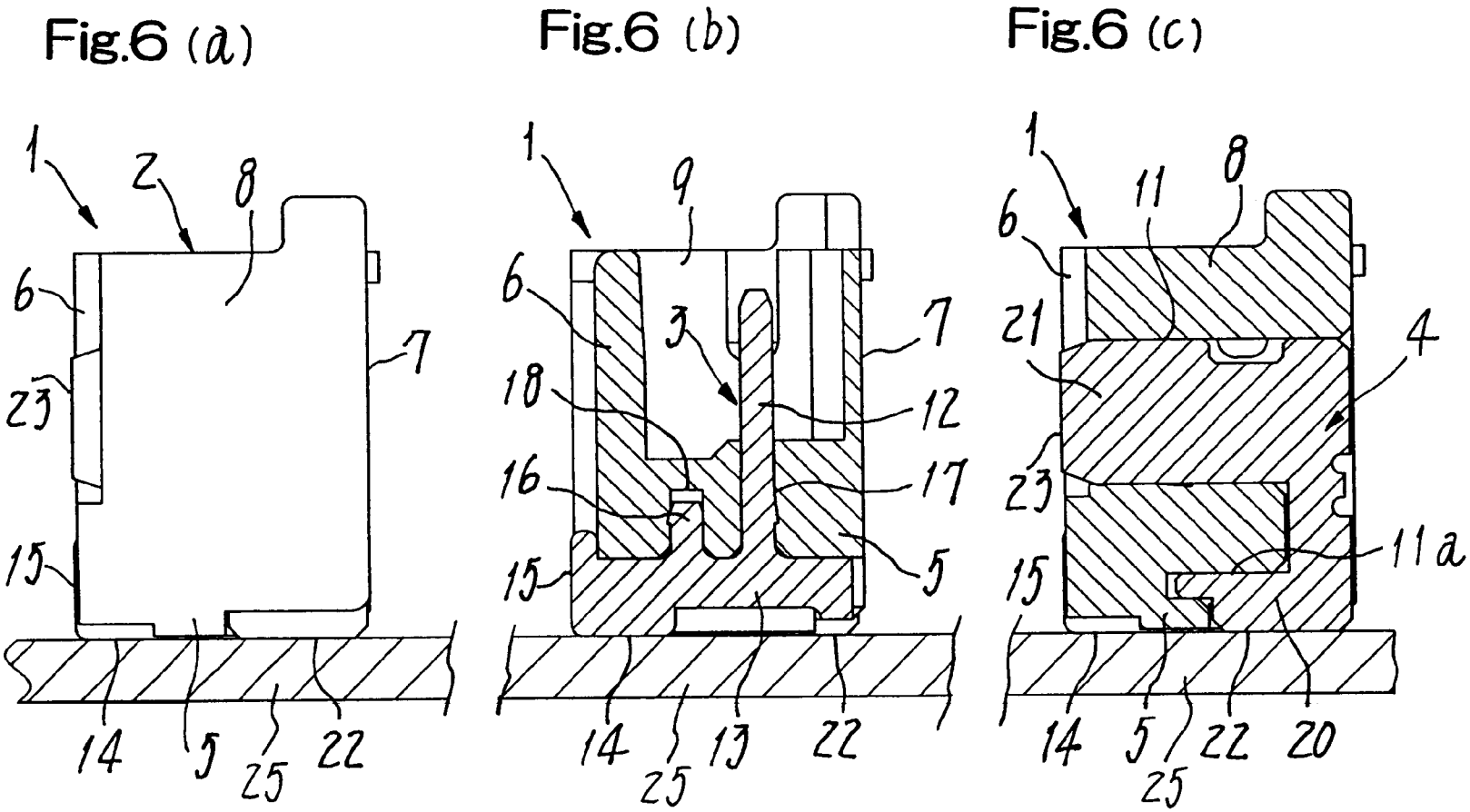
FIG. 6(*a*) is a side elevation of the connector taking a top type position and surface-mounted on a printed circuit board.
Figure 7:
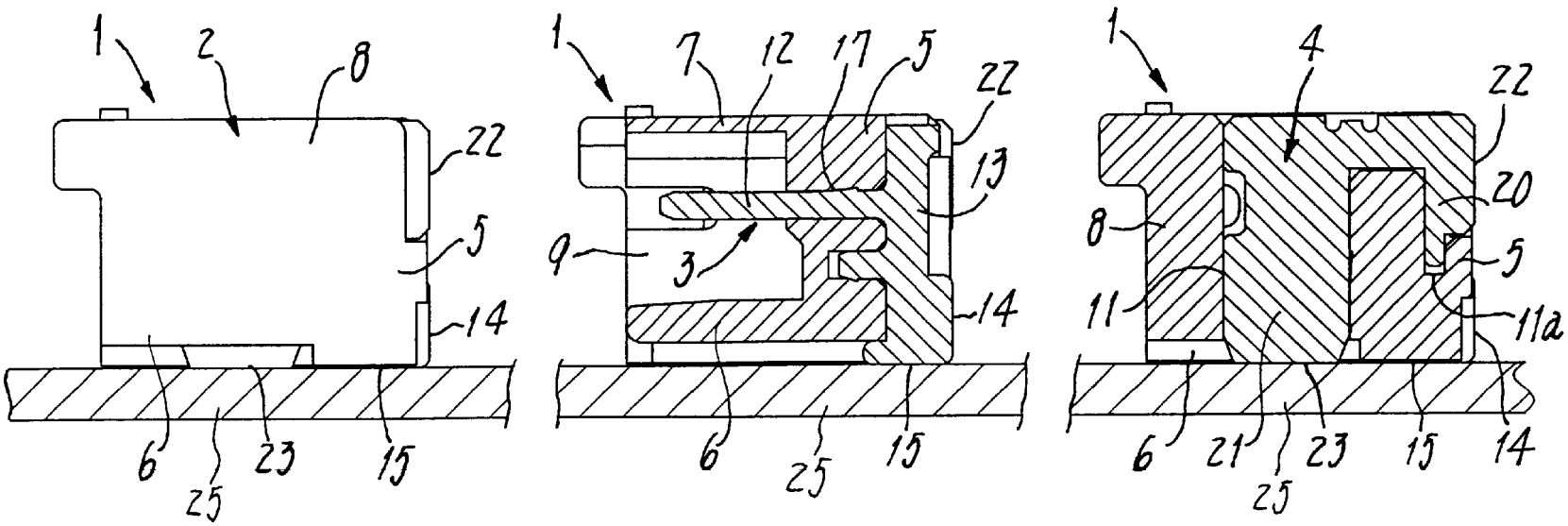
FIG. 7(*a*) is a side elevation of the connector taking a side type position and surface-mounted on the printed circuit board.
Figure 8:
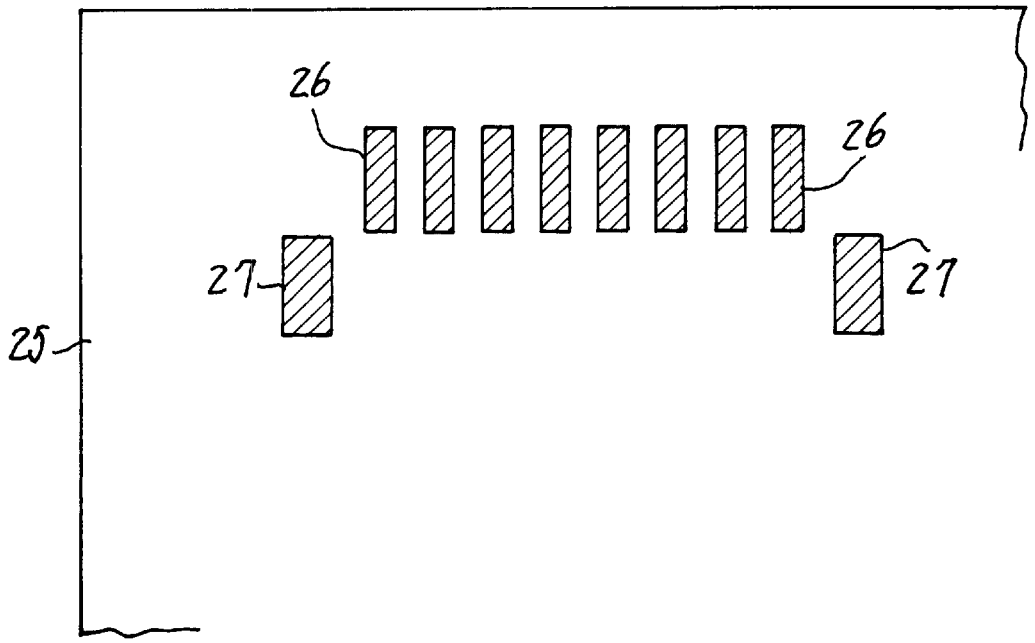
FIG. 8 is a plan view of a layout of printed patterns that are formed on the circuit board on which the connector will be surface-mounted.

FIGS. 6(*a*) to 6(*c*) and FIGS. 7(*a*) to 7(*c*) show the connector 1 of the described structure proposed herein and in an exemplary use. FIG. 8 illustrates a layout of a circuit pattern 26 combined with a fixation pattern 27, both printed on the board 25 to which the connector 1 has to be surface mounted.

FIGS. 6(*a*) to 6(*c*) show the connector 1 in its top type position on the printed circuit board 25, wherein the bottom 5 of the housing 2 rests on the surface of said board so that the open top 9 faces upwards. As seen in FIG. 6(*b*), the first solderable portion 14 of each contact 3 used in the top type position will be soldered to the circuit pattern 26 (see FIG. 8). Consequently, the other solderable portion 15 for the side type position is exposed from and along the front wall 6 of the housing. On the other hand, each reinforcement piece 4 as best seen in FIG. 6(*c*) will have its lower arm 20 disposed such that its first solderable zone 22 may be soldered to the fixation pattern 27 (see FIG. 8) on the printed circuit board 25. The second solderable zone 23 will thus be exposed from and along the front wall 6.

FIGS. 7(*a*) to 7(*c*) show the connector 1 with the housing 2 in the side type position when surface-mounted on the circuit board 25 so that the open top 9 will face sideways. As seen in FIG. 7(*b*), the second solderable portion 15 of each contact 3 in the side type position will be soldered to the circuit pattern 26 of said printed board. Consequently, the other solderable portion 14 for the top type position is exposed from and along the housing's bottom now lying on one of its sides. On the other hand, the upper arm 21 of each reinforcement piece 4 shown in FIG. 7(*c*) will have its second solderable zone 23 soldered to the fixation pattern 27 on the circuit board 25. The first solderable zone 22 will thus be exposed from and along the bottom lying on its side.

Positional relationship between the first solderble portions 14 and zones 22 of the contacts 3 and metal pieces 4 all arranged for the top type position is strictly the same as another positional relationship between the second solderble portions 15 and zones 23 all arranged for the side type position. Thanks to this feature, the one and single layout shown in FIG. 8 and composed of the circuit pattern 26 and fixation pattern 27 is useful per se in both the top type and side type positions.

Figure 9:
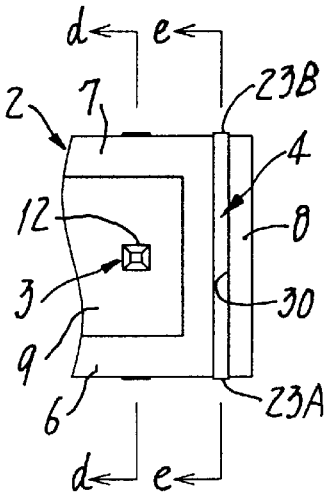
FIG. 9(*a*) is a plan view of a connector alternatively provided in another embodiment and shown at its principal part.
Figure 9:
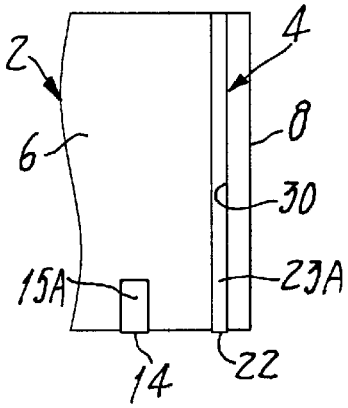
Figure 9:
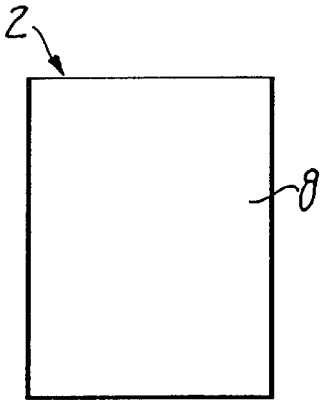
Figure 9:
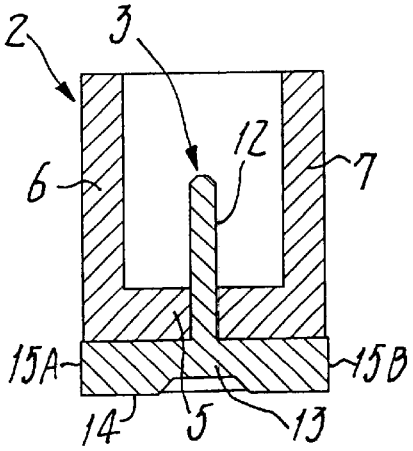
Figure 9:
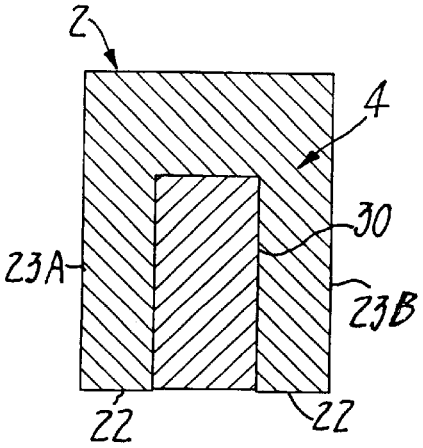

FIGS. 9(*a*) to 9(*e*) illustrate another embodiment, wherein either the front wall 6 or rear wall 7 may selectively be laid on the printed circuit board 25 where the connector 1 is used as a side type one. As shown in FIG. 9(*d*), the lead 13 of each contact 3 set in place in the housing 1 will have its lower edge capable of serving as a first solderable portion 14 that extends along the housing's bottom 5, as in the first embodiment. However, both of frontal and rearward edges of the lead 13 are formed as second solderable portions for the side type position. One of those second portions 15A extends along the front wall 6, with the other one 15B extending along the rear wall 7. Further, as shown in FIG. 9(*e*), each reinforcement metal piece 4 is U-shaped to have the substantially same outer contour as the housing 2 seen in its side elevation. Such a metal piece 4 will fit in a U-shaped groove 30 formed in each side wall 8 of the housing 2, and have a discontinuous lower edge lying parallel with the bottom 5 and across the piece's 4 U-shaped opening, serving in combination for the top-type position as a first solderable zone 22. A frontal edge and a rearward edge of the U-shaped piece are usable as one of second solderable zones 23A and the other 23B respectively for selective use in the side type position, the former zone extending along the front wall 6 and the latter along the rear wall 7.

Figure 10:
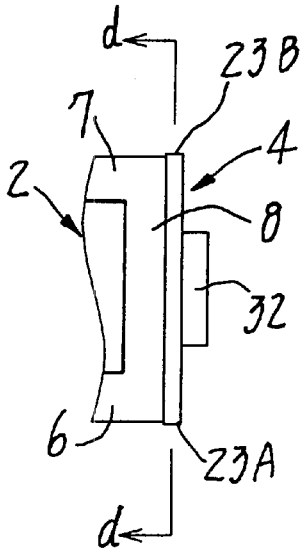
FIG. 10(*a*) is a plan view of a connector further alternatively provided in still another embodiment and shown at its principal part.
Figure 10:
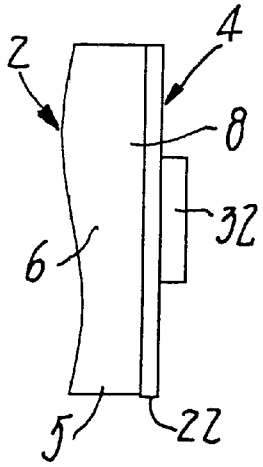
Figure 10:
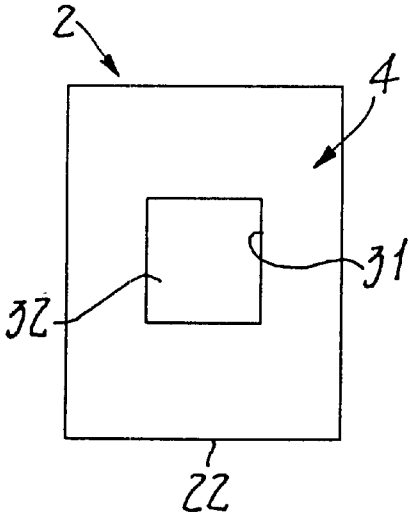
Figure 10:
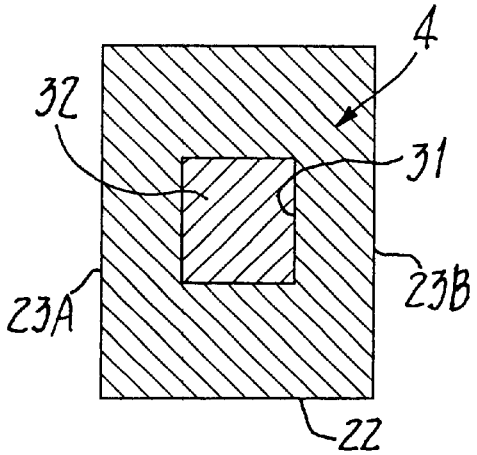

FIGS. 10(*a*) to 10(*d*) present a modification of the embodiment shown in FIGS. 9(*l*) to 9(*e*). The contacts in this modification are the same as those employed in the preceding embodiment shown in FIG. 9(*d*), though each reinforcement piece 4 is of a rectangular outer contour as seen in FIG. 10(*d*) in conformity with the side elevation of housing 2. A central opening 31 of the reinforcement metal piece will fit on a protuberance 32 raised from the side wall 8 so as to be fixed on the housing. A lower edge 22 of such a rectangular piece 4 thus fixed in place will also extend along the bottom 5 so as to serve in the top-type position as a first solderable zone 22. Similarly to the preceding embodiment, a frontal edge and a rearward edge of this piece are usable as one of second solderable zones 23A and the other 23B respectively for selective use in the side type position, the former zone extending along the front wall 6 and the latter along the rear wall 7.

It will now be apparent that the present invention provides such a connector that all of its insulated housing, its contacts and its reinforcement metal pieces need not be changed at all in their shape and structure, whether it takes a top type position or a side type position. This feature will improve manufacture efficiency by reducing facility investment and decreasing the number and kinds of constituent parts, whereby manufacture cost is lowered to a remarkable degree and the stock control of parts becomes much easier.

In addition, such an improved connector can now be 'surface mounted' on a reduced area of the circuit board so as to enhance density of various electric parts and devices mounted thereon. This is because all of the solderable portions of the contacts and the zones of the reinforcement pieces do not protrude out from the housing but extend along the bottom, front wall or rear wall, whether said portions and zones are for the top type position or for the side type position.

Further, the reinforcement metal pieces can more firmly be fixed on the circuit board so as not to be peeled off accidentally and unintentionally, thus improving reliability thereof.

What is claimed is:

1. A connector for printed circuit boards, the connector comprising:

an insulated housing having an opened connecting portion, contacts held in the housing, leads integral with the contacts, protruding outwards therefrom and capable of being soldered to a circuit pattern printed on the board, and reinforcement metal pieces fixed in both sides of said housing and capable of being soldered to a fixation pattern formed on the circuit board, wherein all of the housing, contacts and metal pieces are convertible from such a top type position of the connector that the opened connecting portion faces upwards to such an alternative side type position of the connector that said connecting portion faces sideways, or vice versa, without necessitating any change in shape, wherein each of the leads extending from each contact has a first solderable surface portion and at least one second solderable surface portion, such that the first solderable surface portion extends in the same plane as an outer face of a bottom of the housing so as to be used where the top type position is taken, with the at least one second solderable surface portion extending in the same plane as an outer face of at least one of a front wall and a rear wall of said housing for use in the side type position, and wherein each reinforcement metal piece has a first solderable surface zone and at least one second solderable surface zone, such that the first solderable surface zone extends in the same plane as an outer face of the housing bottom for use where the top type position is taken, with the at least one second solderable surface zone extending in the same plane as an outer face of at least one of the front and rear walls of said housing for use in the side type position.

2. A connector as defined in claim 1, wherein each reinforcement piece consists of a metal sheet having solderable surface portions, one of these solderable surface portions serving as the first solderable zone for the top type position and another one serving as the second solderable zone for the side type position, and each reinforcement piece fixedly fits in one of apertures that are formed in side walls of the insulating housing.

3. A connector as defined in claim 2, wherein each reinforcement piece consists of the metal sheet that is of a U-shape comprising an upper broader arm and a narrower lower arm, such that an outer edge of the upper arm serves as the second solderable zone, and a lower edge of the lower arm serves as the first solderable zone.

4. A connector for printed circuit boards, the connector comprising:

an insulated housing having an opened connecting portion, contacts held in the housing, leads integral with the contacts, protruding outwards therefrom and capable of being soldered to a circuit pattern printed on the board, and reinforcement metal pieces fixed in both sides of said housing and capable of being soldered to a fixation pattern formed on the circuit board, wherein all of the housing, contacts and metal pieces are convertible from such a top type position of the connector that the opened connecting portion faces upwards to such an alternative side type position of the connector that said connecting portion faces sideways, or vice versa, without necessitating any change in shape, wherein each of the leads extending from each contact has a first solderable surface portion and two second solderable surface portions, such that the first solderable surface portion extends in parallel with a bottom of the housing so as to be used where the top type position is taken, with the two second solderable surface portions respectively extending in parallel with the front and rear walls of said housing for use in the side type position, and wherein each reinforcement metal piece has the first solderable surface zone and two second solderable surface zones, such that the first solderable surface zone extends in parallel with the housing bottom for use where the top type position is taken, with the two second solderable surface zones respectively extending in parallel with the front and rear walls of said housing for use in the side type position.

5. A connector as defined in claim 4, wherein each reinforcement piece consists of a metal sheet having solderable surface portions, one of these solderable portions serving as the first solderable zone and another one serving as the second solderable zone, and each reinforcement piece fixedly fits in one of grooves that are formed in side walls of the insulated housing.

6. A connector as defined in claim 5, wherein each reinforcement piece is a U-shaped metal plate, such that opposite side edges of each reinforcement piece respectively extend in parallel with the front and rear walls of the housing and are capable of serving as the second solderable zones, and a lower edge of each reinforcement piece extending along the housing bottom is capable of serving as the first solderable zone.

7. A connector as defined in claim 4, wherein each reinforcement piece is a rectangular metal plate which has a central opening and whose contour is substantially the same as a side elevation of the housing, such that opposite side edges of each reinforcement piece respectively extend in parallel with the front and rear walls of the housing and are capable of serving as the second solderable zones, and a lower edge extending along the housing bottom is capable of serving as the first solderable zone, and wherein the central opening of each reinforcement piece firmly fits on a protuberance protruding from each side wall of the housing so as to secure thereon the piece.

8. A connector as defined in any one of the preceding claims 1 through 7, wherein a positional relationship among the first solderable portions and zones is the same as a positional relationship among the second solderable portions and zones.

* * * * *